US009605851B2

(12) United States Patent
Marcakis

(10) Patent No.: US 9,605,851 B2
(45) Date of Patent: Mar. 28, 2017

(54) VARIABLE AIR INTAKE CONTROL FOR RAPID FIRE STARTING IN SOLID FUEL BURNING APPLIANCES

(71) Applicant: Emmanuel Marcakis, Montreal (CA)

(72) Inventor: Emmanuel Marcakis, Montreal (CA)

( * ) Notice: Subject to any disclaimer, the term of this patent is extended or adjusted under 35 U.S.C. 154(b) by 392 days.

(21) Appl. No.: 14/226,769

(22) Filed: Mar. 26, 2014

(65) Prior Publication Data

US 2015/0276228 A1 Oct. 1, 2015

(51) Int. Cl.
*F24B 1/02* (2006.01)
*F24B 5/02* (2006.01)
*F24B 1/19* (2006.01)

(52) U.S. Cl.
CPC ..... *F24B 5/023* (2013.01); *F24B 1/028* (2013.01); *F24B 1/19* (2013.01)

(58) Field of Classification Search
CPC ..... F24B 1/028; F24B 1/19; F24B 5/023
USPC ..... 126/77, 112, 518
See application file for complete search history.

(56) References Cited

U.S. PATENT DOCUMENTS 844,292 A 2/1907 Thurston
1,186,303 A 6/1916 Frost
1,798,431 A 3/1931 McWilliams
3,168,088 A 2/1965 Martin et al.
3,318,524 A 5/1967 Kehm
4,248,206 A * 2/1981 Orthey, Jr. ..... F24B 1/19 126/518
4,409,956 A 10/1983 Barnett
4,530,346 A 7/1985 Roy
4,646,712 A 3/1987 Ferguson
4,691,686 A * 9/1987 Alvarez ..... F24B 1/028 110/203
6,041,770 A 3/2000 Erickson

* cited by examiner

*Primary Examiner* — Avinash Savani

(57) ABSTRACT

A variable air intake control for rapid fire starting in solid fuel burning appliances has an air intake chamber member adapted to be positioned on the top side of the solid fuel burning appliance and adapted to allow air to pass therethrough.

The air intake chamber member has an air intake opening located adjacent to one end of a top side thereof and an air outflow opening adjacent an opposite end to the one end and located on a bottom side thereof.

A pipe member attached to the air outflow opening at a first end and adapted to channel the air to pass therethrough and exit at a second end thereof underneath the solid fuel burning appliance to be used for rapid fire starting. A gate member pivotally attached at one end to the top side of the air intake chamber member and adapted to uncover the air intake opening in an initial position and progressively pivot and cover the air intake.

An elongated connector member connected to the gate member at a distal end portion opposite from the pivotally attached one end and adapted to pivot the gate member in conjunction with a primary air supply of the solid fuel burning appliance, to thereby increase the air flow to the solid fuel burning appliance when starting a fire and thereby increase the rate at which the fire is started and burns. As the temperature sizes the the air will be reduced gradually by the primary air control U.S. Pat. No. 7,325,541.

9 Claims, 5 Drawing Sheets

FIG. 3a
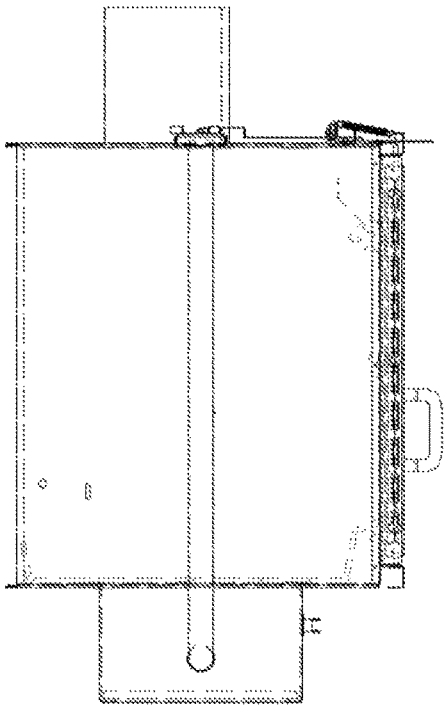
FIG. 3b
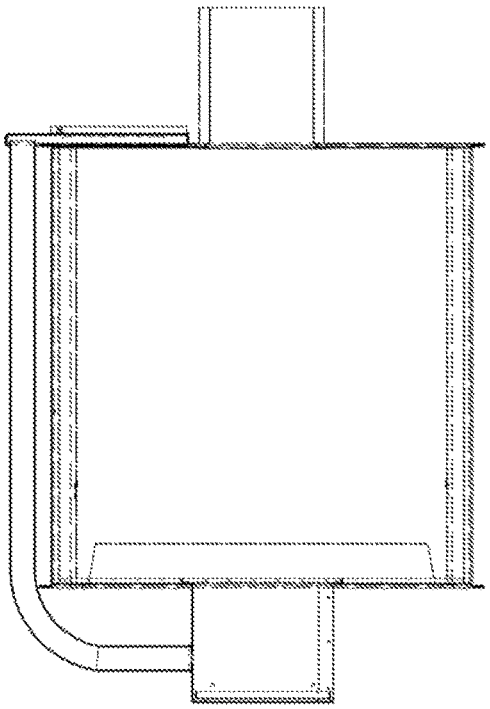
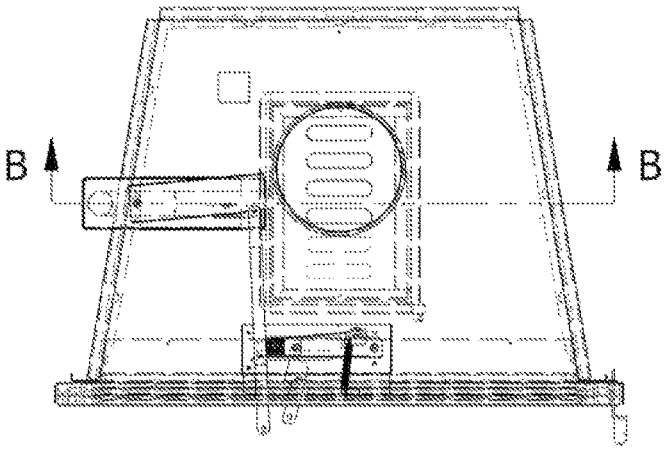
FIG. 3c

VARIABLE AIR INTAKE CONTROL FOR RAPID FIRE STARTING IN SOLID FUEL BURNING APPLIANCES

FIELD OF THE INVENTION

The present invention relates generally to wood burning appliances but more particularly to a variable air intake control for rapid fire starting in solid fuel burning appliances.

BACKGROUND OF THE INVENTION

Applicant has filed U.S. Pat. No. 7,325,541 regarding an air control gate which is used to control combustion throughout the burning cycle. However, starting a fire is the most difficult and critical phase. There is a need for an improvement in the fire starting phase.

SUMMARY OF THE INVENTION

In view of the foregoing disadvantages inherent in the known devices now present in the prior art, the present invention, which will be described subsequently in greater detail, is to provide objects and advantages which are:

To provide for a way to ensure a successful ignition of the wood without further intervention from the user.

In order to do so, the variable air intake control device for rapid fire starting in a solid fuel burning appliance has an air intake chamber member adapted to be positioned on the top side of the solid fuel burning appliance and adapted to allow air to pass therethrough.

The air intake chamber member has an air intake opening located adjacent to one end of a top side thereof and an air outflow opening adjacent an opposite end to the one end and located on a bottom side thereof.

A pipe member attached to the air outflow opening at a first end and adapted to channel the air to pass therethrough and exit at a second end thereof underneath the solid fuel burning appliance to be used for rapid fire starting. A gate member pivotally attached at one end to the top side of the air intake chamber member and adapted to uncover the air intake opening in an initial position and progressively pivot and cover the air intake opening while in use.

An elongated connector member connected to the gate member at a distal end portion opposite from the pivotally attached one end and adapted to pivot the gate member in conjunction with a primary air supply of the solid fuel burning appliance, to thereby increase the air flow to the solid fuel burning appliance when starting a fire and thereby increase the rate at which the fire is started and burns and gradually reduces the burn rate after proper burning has been established.

The variable air intake control device has an air intake chamber member formed in the shape of a rectangular box.

The pipe member is elongated and includes a curved portion adapted to curve below the solid fuel burning appliance.

The connector member is pivotally connected to the gate member at the distal end portion of the variable air intake control device.

The variable air control device is activated by a heat sensitive mechanism as described in U.S. Pat. No. 7,325,541 by this inventor.

The variable air intake control device works in combination with a solid fuel burning appliance and the heat sensitive mechanism as described in U.S. Pat. No. 7,325,541 by this inventor.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

BRIEF DESCRIPTION OF THE DRAWINGS

FIGS. 3*a-c* Side, front, and top views of the invention in context.

DETAILED DESCRIPTION OF THE PREFERRED EMBODIMENT

Figure 1:
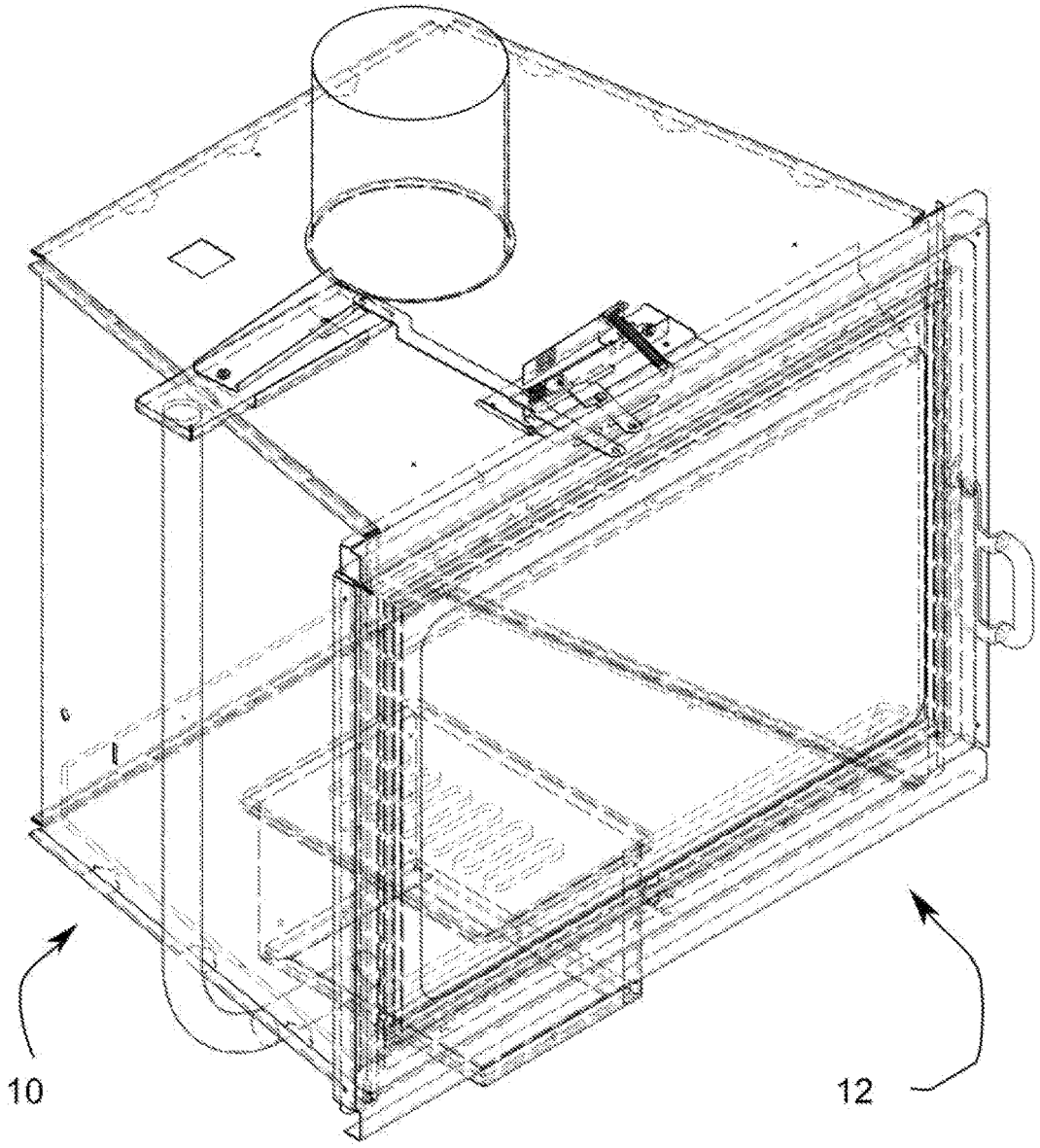
FIG. 1 Isometric view of the invention in context.
Figure 2:
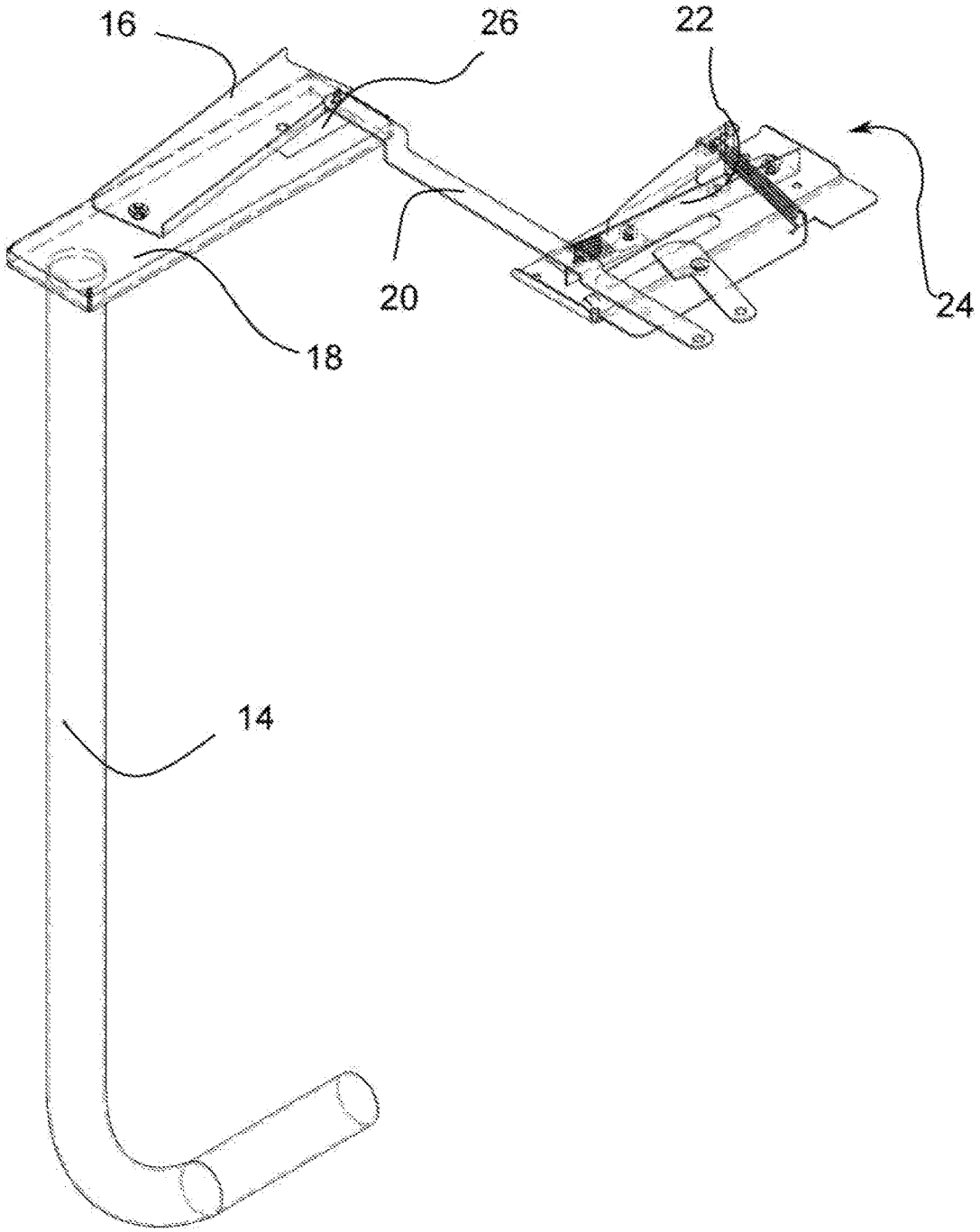
FIG. 2 Isometric view of the invention.
Figure 4A:
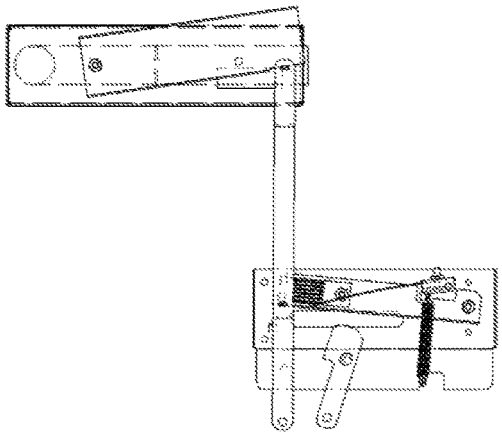
FIGS. 4*a-c* Top, front, and side of the invention along with the primary air supply.
Figure 4B:
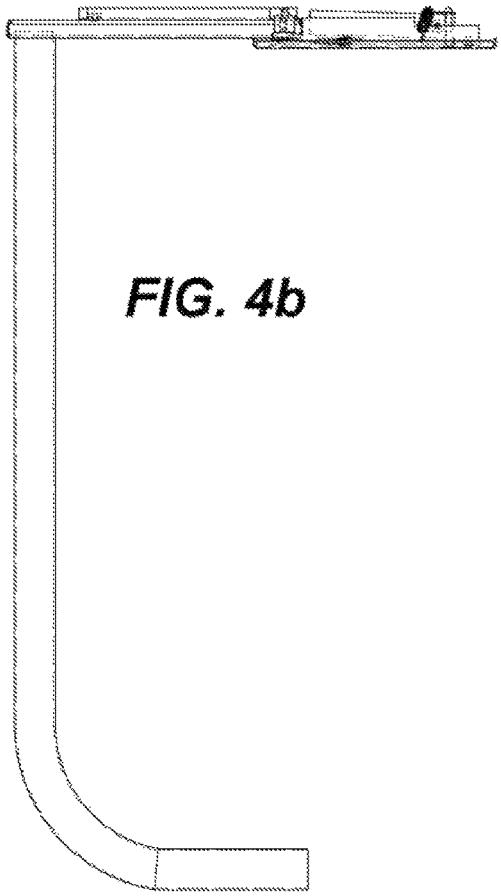
Figure 4C:
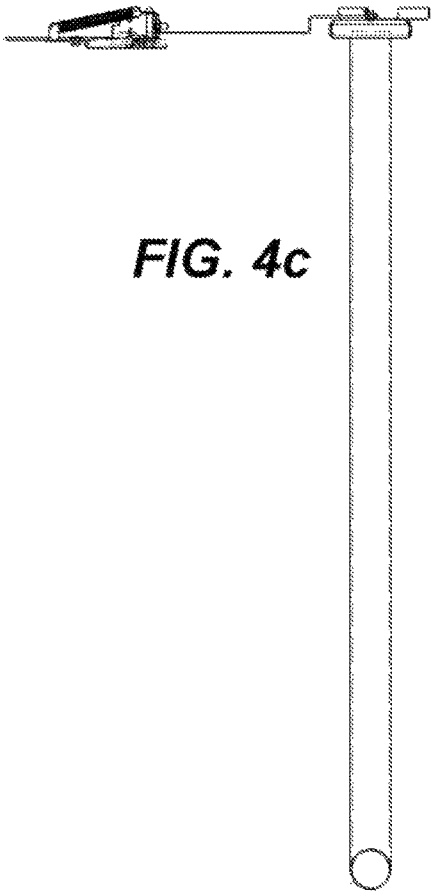
Figures 5A, 5B:
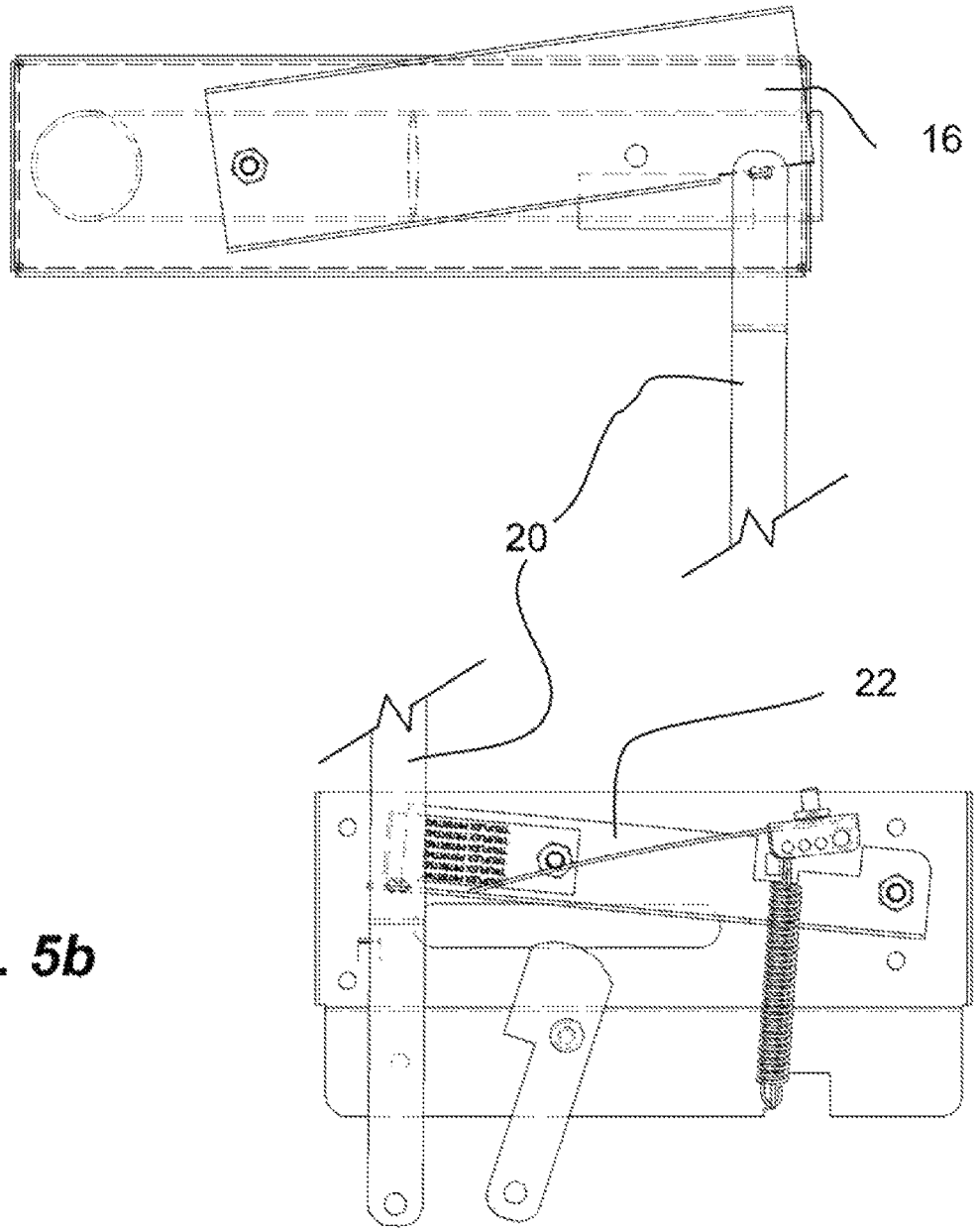
FIGS. 5*a-b* Top views of the chamber and connector member connecting with the "L" shaped gate in FIG. 5*b*.

A variable air intake control for rapid fire starting (10) for use in a solid fuel burning appliance (12) is comprised of a pipe member (14), a gate member (16), and a chamber member (18).

The gate member (16) controls the size of the opening of an air intake (26). The air then travels through the chamber member (18) before entering the pipe member (14) located at the opposite end of the chamber member (18).

The opening and closing of the gate member (16) is done by way of a connector member (20) which connects the gate member (16) to an "L" shaped gate (22) located on a primary air supply (24). The primary air supply (24) is described in U.S. Pat. No. 7,325,541, also by this inventor and as such, need not be further discussed herein.

A user first activates the connector member (20) manually when starting a fire, but as the burning progresses and the temperature rises, the connector member (20) is being actuated by the "L" shaped gate (22) and reduces the burn rate to the preset burn rate determined by the primary air control, without any further intervention by the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A variable air intake control device for rapid fire starting in a solid fuel burning appliance, said variable air intake control device comprising an air intake chamber member adapted to be positioned on the top side of said solid fuel burning appliance and adapted to allow air to pass therethrough, said air intake chamber member having an air intake opening located adjacent to one end of a top side thereof and an air outflow opening adjacent an opposite end to said one end and located on a bottom side thereof; a pipe member attached to said air outflow opening at a first end and adapted to channel said air to pass therethrough and exit at a second end thereof underneath said solid fuel burning appliance to be used for rapid fire starting; a gate member pivotally attached at one end to said top side of said air intake chamber member and adapted to uncover said air intake opening in an initial position and progressively pivot and cover said air intake opening while in use; and an elongated connector member connected to said gate member at a distal end portion opposite from said pivotally attached one end and adapted to pivot said gate member in conjunction with a primary air supply control of said solid fuel burning appliance, to thereby increase the air flow to said solid fuel burning appliance when starting a fire and thereby increase the rate at which said fire is started and burns and gradually reduces the burn rate after proper burning has been established; said air intake chamber member is formed in the shape of a rectangular box.

2. The variable air intake control device of claim 1, wherein said pipe member is elongated and includes a curved portion adapted to curve below said solid fuel burning appliance.

3. The variable air intake control device of claim 1, wherein said connector member is pivotally connected to said gate member at said distal end portion.

4. The variable air intake control device of claim 1, wherein said variable air intake control device is formed from a material that is sensitive to heat.

5. A combination of a solid fuel burning appliance and a variable air intake control device for rapid fire starting, said combination comprising:

a solid fuel burning appliance Including a burning appliance body portion having an interior adapted to be heated by a burning chamber; a burning chamber attached to a bottom portion of said burning appliance body portion; an exhaust member passing through a top surface of said body portion and extending upward therefrom and adapted to allow air, smoke, and fumes to exit said interior; and a primary air supply mechanism attached to a top surface of said burning appliance body portion and includes an air supply opening passing therethrough and through said top surface of said burning appliance body portion, and a gate member pivotally attached thereto and adapted to uncover said air supply opening to an initial position when starting a fire in said burning chamber and progressively pivot and cover said air intake opening while in use; and said variable air intake control device comprising an air intake chamber member positioned on said top surface of said solid fuel burning appliance and adapted to allow air to pass therethrough, said air intake chamber member having an air intake opening located adjacent to one end of a top side thereof and an air outflow opening adjacent an opposite end to said one end and located on a bottom side thereof; a pipe member attached to said air outflow opening at a first end, is attached to said burning chamber of said solid fuel burning appliance at a second end thereof , and is adapted to channel said air to pass therethrough and exit into said burning chamber, a gate member pivotally attached at one end to said top side of said air intake chamber member and adapted to uncover said air intake opening in an initial position and progressively pivot and cover said air intake opening while in use; and an elongated connector member connected to said gate member at a distal end portion opposite from said pivotally attached one end, is attached at an opposite end to said gate member of said primary air supply mechanism of said solid fuel burning appliance, and is adapted to pivot said gate member in conjunction with said gate member of said primary air supply of said solid fuel burning appliance, to thereby increase the air flow to said burning chamber of said solid fuel burning appliance when starting a fire and thereby increase the rate at which said fire is started and burns; said variable air intake chamber member is formed in the shape of a rectangular box.

6. The combination of claim 5, wherein said pipe member is elongated and includes a curved portion adapted to curve below said solid fuel burning appliance.

7. The combination of claim 5, wherein said connector member is pivotally connected to said gate member at said distal end portion.

8. The combination of claim 5, wherein said variable air intake control device is formed from a material that is sensitive to heat.

9. The combination of claim 6, wherein said air intake chamber member is located upon said top surface of said solid fuel burning appliance such that said air intake opening is located upon said top surface of said solid fuel burning appliance, and said air outflow opening hangs over an edge of said top surface of said solid fuel burning appliance, such that said pipe member proceeds straight down a side of said burning appliance body portion, and wherein said curved portion curves below said solid fuel burning appliance and into said burning chamber.

* * * * *